United States Patent [19]

Kondo et al.

[11] 4,309,579

[45] Jan. 5, 1982

[54] GANGED PUSH-BUTTON SWITCH

[75] Inventors: Shiro Kondo; Yasuo Takii, both of Furukawa, Japan

[73] Assignee: Alps Electric Co., Ltd., Tokyo, Japan

[21] Appl. No.: 139,712

[22] Filed: Apr. 14, 1980

[30] Foreign Application Priority Data

Apr. 20, 1979 [JP] Japan ..... 54-53235[U]

[51] Int. Cl.[3] ..... H01H 9/26

[52] U.S. Cl. ..... 200/5 E; 74/483 PB; 200/50 C

[58] Field of Search ..... 200/5 E, 5 EA, 5 EB, 200/50 C, 328; 74/483 PB

[56] References Cited

U.S. PATENT DOCUMENTS 2,933,945 4/1960 Brewster et al. ..... 74/483 PB X
3,420,969 1/1969 Edwards et al. ..... 200/5 EA
3,517,140 6/1970 Bailey et al. ..... 200/5 E
3,889,075 6/1975 Morrell et al. ..... 200/50 C X
3,927,283 12/1975 Kunimine ..... 200/5 E X

*Primary Examiner*—James R. Scott
*Attorney, Agent, or Firm*—Guy W. Shoup; Gerard F. Dunne

[57] ABSTRACT

In a ganged push-button switch in which a plurality of push-button switches are mounted on a frame, each of said push-button switches having an operation rod with a cam portion formed in one side surface thereof, and a first interlocking plate is urged onto each of the cam portions of said push-button switches mounted on said frame, the improvement wherein a second cam portion is formed in the upper surface of said operation rod of each of said push-button switches, said second cam portion being formed at right angles with said cam portions, and a second interlocking plate is urged onto said second cam portion.

5 Claims, 5 Drawing Figures

GANGED PUSH-BUTTON SWITCH

BACKGROUND OF THE INVENTION

The present invention relates to a ganged push-button switch which is particularly suited for such applications as automobiles and motorcycles.

According to the conventional ganged push-button switches as have been disclosed in, for example, U.S. Pat. Nos. 3,927,283, 3, 889,075 and 3,836,736, a plurality of push-button switches are mounted in parallel on a frame, and respective portions of an interlocking plate act upon the cams portions are provided for each of the plurality of push-button switches, so that when any one of the push-button switches is depressed, another push-button switch which had been locked is unlocked.

With such ganged push-button switches having only one interlocking plate, however, a push-button switch which should be kept locked is often unlocked if subjected to a strong impact. Therefore, the conventional ganged push-button switches leave much room for improvement when they are to be used in automobiles and motorcycles which are often subject to vibration.

SUMMARY OF THE INVENTION

The object of the present invention therefore is to provide a ganged push-button switch which will not operate erroneously even when subjected to vibration or impact.

Another object of the present invention is to provide a ganged push-button switch having two sets of interlocking mechanisms.

Further objects and advantages of the invention will become apparent from the description of the invention in conjunction with the accompanying drawings.

DESCRIPTION OF THE PREFERRED EMBODIMENT

The invention is illustrated below with reference to FIGS. 1 to 4.

Figure 1:
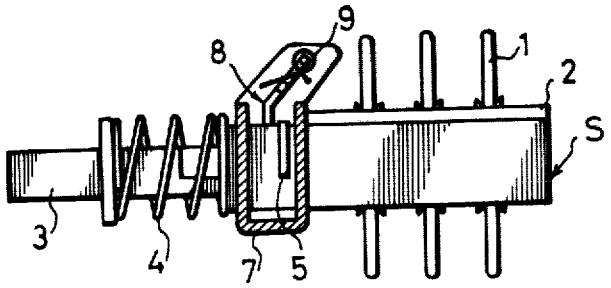
FIG. 1 is a side view of a ganged push-button switch according to the present invention.
Figure 2:
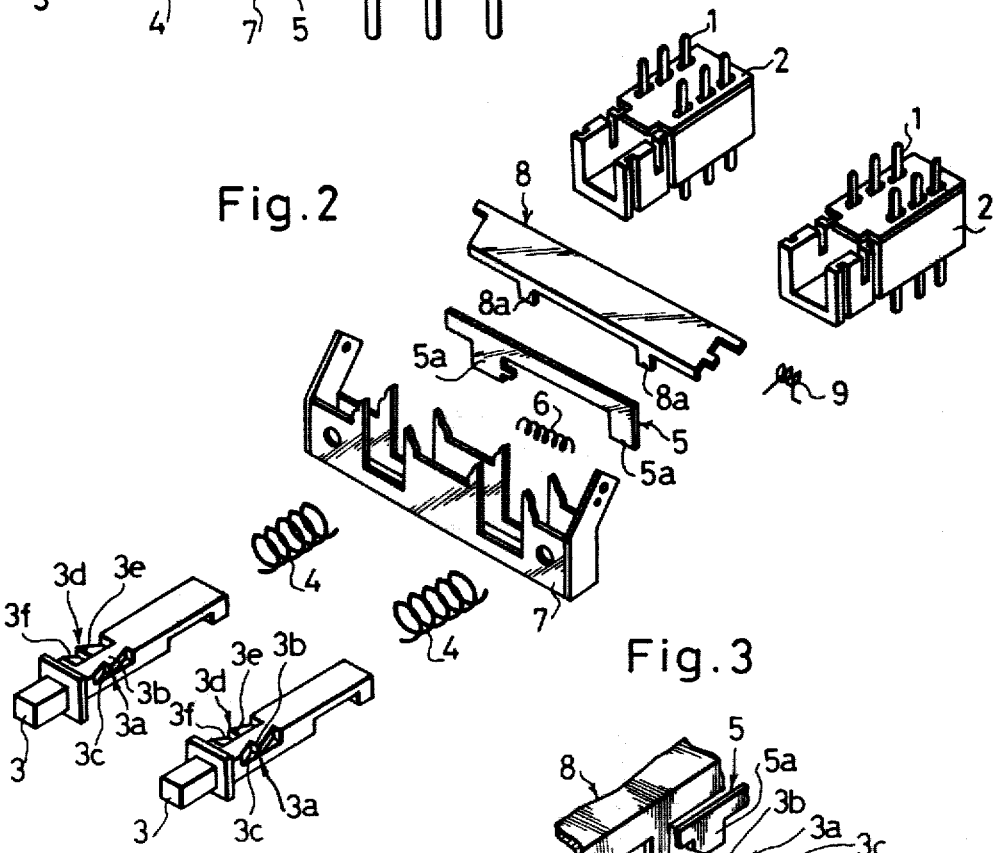
FIG. 2 is a perspective view when the ganged push-button switch of the present invention is disassembled.

Referring to FIG. 1, a push-button switch S consists of a casing 2 on which are studded fixed terminals 1, an operation rod 3, a return spring 4, a first interlocking plate 5, a second interlocking plate 8, and a metallic frame 7 for holding the push-button switches together. FIG. 2 illustrates the ganged push-button switch in a disassembled manner, from which the shapes of the first interlocking plate 5, a spring 6 associated with the first interlocking plate, the second interlocking plate 8, and a spring 9 related to the second interlocking plate, can be understood. FIG. 2 further clarifies relations in positions of first cam portions 3*a* to 3*c* and second cam portions 3*d* to 3*f* formed in the operation rod 3.

Figure 3:
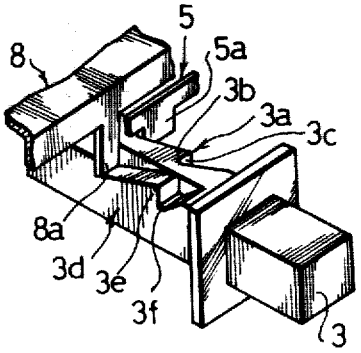
FIG. 3 is a perspective view illustrating, on an enlarged scale, cam portions employed for the ganged push-button switch of the present invention.

As will be evident from FIG. 3, the first cam portions 3*a* to 3*c* are formed in one side of the operation rod 3, which side is urged by the first interlocking plate 5 via the spring 6. The second cam portions 3*d* to 3*f* are formed in the upper surface of the operation rod 3 at right angles with the side surface, which upper surface is urged by the second interlocking plate 8 via the spring 9.

Figure 4A:
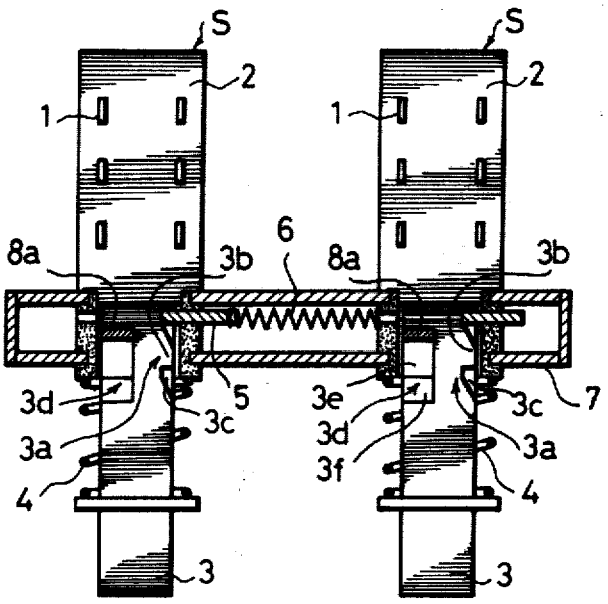
FIG. 4*a* is an upper view for illustrating, partly in cross section, the operation of the ganged push-button switch of the present invention, in which none of the push-button switches have been depressed.
Figure 4B:
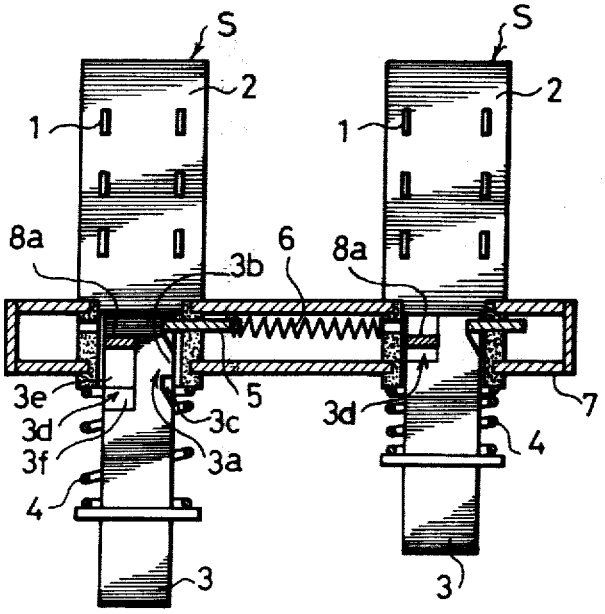
FIG. 4*b* is an upper view illustrating, partly in cross section, the state when one push-button switch is depressed.

The ganged operation of the ganged push-button switch of the present invention is described below with reference to FIGS. 4*a* and 4*b*. First, if a push rod 3 is depressed, a projecting portion 3*b* on the first cam portion 3*a* forces the first interlocking cam plate 5 against the resilient force of the spring 6 and, at the same time, a ridge portion 3*e* on the second cam portion 3*d* forces the second interlocking cam plate 8 against the resilient force of the spring 9. As the operation rod 3 is moved further, an engaging portion 5*a* on the first interlocking plate 5 falls into an engaging recess 3*c* after passing over the projecting portion 3*b* of the first cam portion 3*a*, and an engaging portion 8*a* on the second interlocking plate 8 falls into an engaging valley 3*f* after passing over the ridge portion 3*e* of the second cam portion 3*d*. Thereafter, when the depressing force is discontinued, the first and second cam portions 3*a*, 3*d* of the operation rod 3 are engaged with the engaging portions 5*a*, 8*a* of the first and second interlocking plates 5, 8, and the operation rod 3 is locked by the two interlocking plates 5, 8.

Then, when another operation rod 3 is depressed, the first and second cam portions 3*a*, 3*d* of that operation rod force the first and second interlocking plates 5, 8 into their non-engaging position. The depressed operation rod is then locked owing to the same operation mentioned in the foregoing. Further, when this operation rod 3 is depressed causing the interlocking plates 5, 8 to be moved against the resilience of the respective springs, the operation rod 3 which had been depressed is unlocked from the interlocking plates 5, 8 and is returned to the initial state being urged by the return spring. Thus, the ganged operation of a plurality of operation rods 3 is effected.

In short, according to the present invention, the first and second cam portions 3*a*, 3*d* are formed in each of the operation rods 3 at positions at right angles to each other, wherein the first cam portion 3*a* is detachably engaged with the first interlocking plate 5 and the second cam portion 3*d* is detachably engaged with the second interlocking plate 8, so that each operation rod 3 is locked by the two interlocking plates 5, 8. Accordingly, the operation rod 3 can be reliably locked and is not unexpectedly unlocked by vibration or impact. Consequently, the ganged push-button switch of the present invention is suited for such applications as automobiles and motorcycles.

What is claimed is:

1. In an assembly of push-button switches ganged together and each having an operation rod movable inwardly of the respective switch into a latchable position and having a cam part formed in a surface thereof, said assembly having means including an interlocking plate common to said switches and adapted to engage the respective cam parts thereof for holding an operation rod moved into its latchable position while releasing any previously held operation rod, the improvement wherein said operation rods each include a cam portion formed in a surface thereof lying substantially at a right angle to the surface of said cam part, and said holding means including a second interlocking plate common to said switches and adapted to engage the respective cam portions thereof for also holding an operation rod moved into its latchable position while releasing any previously held operation rod, whereby any operation rod moved into its latchable position will be held by the interaction of two interlocking plates operating on respective cam parts and cam portions facing in different directions.

2. An assembly according to claim 1, said first mentioned interlocking plate being adapted to move longitudinally in a direction perpendicular to the movement of said operation rods and said second interlocking plate being adapted to move generally in the same direction as said operation rods.

3. An assembly according to claim 1 or 2, including a frame receiving said switches and supporting the two interlocking plates for their respective movement.

4. An assembly according to claim 3, said first mentioned interlocking plate being supported slidably by said frame and said second interlocking plate being supported pivotally by said frame.

5. An assembly according to claim 4, including springs engaging the respective interlocking plates and urging the respective interlocking plate into engagement with the cam parts or cam portions associated therewith.

* * * * *